US008165330B2

(12) United States Patent
Gottschalk et al.

(10) Patent No.: US 8,165,330 B2
(45) Date of Patent: Apr. 24, 2012

(54) METHOD FOR WIRELESS DATA TRANSFER BETWEEN A HEARING AID AND AN EXTERNAL DEVICE

(75) Inventors: Georg Gottschalk, Erlangen (DE); Gottfried Rückerl, Nürnberg (DE); Gunter Sauer, Erlangen (DE); Ulrich Schätzle, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 509 days.

(21) Appl. No.: 12/309,714

(22) PCT Filed: Jul. 25, 2007

(86) PCT No.: PCT/EP2007/057670

§ 371 (c)(1),
(2), (4) Date: Jan. 27, 2009

(87) PCT Pub. No.: WO2008/012327

PCT Pub. Date: Jan. 31, 2008

(65) Prior Publication Data

US 2010/0008527 A1 Jan. 14, 2010

(30) Foreign Application Priority Data

Jul. 28, 2006 (DE) ..... 10 2006 035 126

(51) Int. Cl.
*H04R 25/00* (2006.01)

(52) U.S. Cl. ..... 381/315; 455/343

(58) Field of Classification Search ..... 455/343; 381/315

See application file for complete search history.

(56) References Cited

U.S. PATENT DOCUMENTS

| | | | | |
|---|---|---|---|---|
| 6,141,357 | A * | 10/2000 | Testani et al. | 370/507 |
| 6,240,194 | B1 | 5/2001 | De Koning | |
| 2002/0034970 | A1 | 3/2002 | Higuchi | |
| 2005/0020322 | A1 | 1/2005 | Ruuska et al. | |
| 2005/0254676 | A1 | 11/2005 | Rass et al. | |
| 2006/0194564 | A1 * | 8/2006 | Hokimoto et al. | 455/343.2 |
| 2006/0274747 | A1 | 12/2006 | Duchscher et al. | |

FOREIGN PATENT DOCUMENTS

| | | | |
|---|---|---|---|
| DE | 102004023049 | A1 | 12/2005 |
| EP | 1494407 | A1 | 1/2005 |
| WO | WO 9816086 | A1 | 4/1998 |
| WO | WO 2005013637 | A1 | 2/2005 |
| WO | WO 2006074655 | A1 | 7/2006 |
| WO | WO 2006133158 | A1 | 12/2006 |

* cited by examiner

*Primary Examiner* — Jerome Jackson, Jr.
*Assistant Examiner* — Dale E Page

(57) ABSTRACT

Data is wirelessly transferred between a hearing aid and an external device, wherein the hearing aid via an internal receiving device, receives data being sent form the external device via a wireless connection. The hearing aid is in a receiving mode when data from the external device is sent via the wireless connection, wherein the receiving device is then permanently in the on-position for receiving data. Furthermore, the hearing aid switches to a stand-by mode, when no data is sent via the wireless connection from the external device, wherein the receiving device is alternatively turned on and off, in order to detect a beginning data transfer from the external device.

18 Claims, 2 Drawing Sheets

METHOD FOR WIRELESS DATA TRANSFER BETWEEN A HEARING AID AND AN EXTERNAL DEVICE

CROSS REFERENCE TO RELATED APPLICATIONS

This application is the US National Stage of International Application No. PCT/EP2007/057670, filed Jul. 25, 2007 and claims the benefit thereof. The International Application claims the benefits of German application No. 10 2006 035 126.6 DE filed Jul. 28, 2006, both of the applications are incorporated by reference herein in their entirety.

FIELD OF INVENTION

The invention relates to a method for the transfer of data via a wireless connection between a hearing aid and an external programming device. In addition to a receiving mode, the hearing aid also has a standby mode in which the energy consumption of the hearing aid is significantly reduced.

BACKGROUND OF INVENTION

In addition to an interface for a wired connection to an external control device, modern hearing aids also have a transmitting/receiving device for the wireless connection of the hearing aid to the external control device. Within the scope of wireless programming, the hearing aid can also receive programming data from an external programming device via a radio link of this kind. This also permits wireless binaural coupling of hearing aids with which the two hearing aids can be coupled together in such a way that they work as an integrated unit and functions such as volume or program selection are synchronized between the two hearing aids. However, a hearing aid with an integrated receiving device for the wireless reception must be expected to have a higher power consumption. Since, as rule, the hearing aid only has access to its internal power supply, the wireless data transfer inevitably results in a reduced operating time and hence in more frequent battery changes. For this reason, it is desirable to keep the additional power consumption caused by the receiving device as low as possible. In addition, with the wireless programming of hearing aids, it is necessary to prevent illegal programming accesses and possibly to work at a higher data rate than that used in normal operation.

SUMMARY OF INVENTION

Since with known systems designed for wireless binaural coupling, the receiving device is permanently activated, resulting however in a relatively high power consumption by the hearing aid, at present, conventional hearing aids are still programmed via a cable connection.

It is the object of the invention, on the basis of this prior art, to provide a method for wireless data transfer between a hearing aid and another device by means of which the energy consumption of the hearing aid in operation can be reduced. This object is achieved by a method with the features of the independent claims. Further advantageous embodiments of the invention are disclosed in the dependent claims.

According to the invention, a method for wireless data transfer between a hearing aid and an external device is provided with which the hearing aid receives, by means of an internal receiving device, data sent from the external device via a wireless connection. It is provided that the hearing aid switches to a receiving mode as soon as data is sent from the external device via the wireless connection, wherein the receiving device in the receiving mode is permanently switched on for the reception of data. In addition, the hearing aid switches to a standby mode when no data are sent from the external device via the wireless connection. In this standby mode, the receiving device is alternately switched on and off in order to detect the start of a data transfer from the external device. Since the receiving device in the standby mode only is only operated temporarily, the power consumption of the hearing aid can be significantly reduced by the use of the standby mode.

In an advantageous embodiment of the invention, the hearing aid changes to the receiving mode as soon as, during a switched-on phase of the standby mode, the receiving device detects the start of a data transfer from the external device via the wireless connection. Since the hearing aid in the standby mode so-to-speak repeatedly "sniffles" into the transfer channel, it is able to recognize the start of a data transfer relatively quickly and change to the receiving mode without any great delay.

A further advantageous embodiment of the invention provides that the hearing aid changes to the standby mode as soon as the receiving device in the receiving mode registers no data transfer from the external device via the wireless connection for a prespecified time. This measure enables it to be ensured that the hearing aid does not remain in the receiving mode for an unnecessarily long time. The enables further energy saving by the hearing aid.

A further advantageous embodiment of the invention provides that the receiving device in the standby mode is periodically switched on and off again, wherein the duration of the switched-on and switched-off phases is selected so that the start of a data transfer from the external device can be detected. The duration of the switched-on and switched-off phases determines the pulse duty ratio with which the hearing aid samples the transfer channel for monitoring purposes. The determination of the duration of this time enables the pulse duty ratio and hence the energy saving to be adapted to the respective requirements.

In a particularly advantageous embodiment of the invention, the external device sends an activation signal to the hearing aid via the wireless connection in order to indicate to the hearing aid the start of a new data transfer. An activation signal preceding the actual data transfer makes it possible to ensure that the hearing aid is already activated when the actual data transfer starts. Since, in this case, the hearing aid is able to receive all the data and no data have to be repeated, this measure results in a higher data transfer rate.

A further advantageous embodiment of the invention provides that the duration of the activation signal is selected so that it exceeds the duration of a switched-off phase of the receiving device 11 in the standby mode of the hearing aid.

This ensures that the activation signal at least partially coincides with a switched-on phase. This has the advantage that it increases the probability of the activation signal being detected by the hearing aid.

A further advantageous embodiment of the invention provides that the activation signal comprises an activation message and a redundant preamble. The duration of the redundant preamble is hereby selected so that the total duration of the activation signal exceeds the duration of a switched-off phase of the receiving device in the standby mode of the hearing aid. This ensures that the hearing aid can receive at least a part of the activation signal in a switched-on phase. Since the preamble is sent before the actual activation message, the hearing aid is able to suppress the subsequent switched-off phases until it has received the actual activation message.

In addition, according to a further advantageous embodiment of the invention, the activation message in the activation signal can be repeated until the total duration of the activation signal exceeds the duration of the switched-off phase of the receiving device in the standby mode of the hearing aid. This alternative also increases the probability of the hearing aid receiving the actual activation message correctly.

A particularly advantageous embodiment of the invention provides that the external device uses a specific modulation method in order to indicate the start of a new data transfer. The hearing aid switches to the receiving mode as soon as it detects that the external device is transferring its data signals by means of the specific modulation method.

Hereby, it is advantageous that a specific modulation method can be identified much more quickly than a corresponding activation message, which possibly can only be received complete. It is also possible to reduce the risk of an inadvertent change to the receiving mode when the special modulation method is only used for data transfer. It is advantageous for the hearing aid to change to the receiving mode as soon as the hearing aid detects that the external device is transferring data signals by means of a specific phase or frequency modulation method.

In a further advantageous embodiment of the invention, the data transfer takes place within the scope of wireless programming of the hearing device, wherein the hearing aid in a special programming mode receives programming data in a wireless manner from an external device serving as a control device. Hereby, it is provided that the hearing aid changes to the programming mode as soon as it receives a special command from the control device via the wireless connection. Programming data sent by the control device outside of the programming mode via the wireless connection to the hearing aid are ignored by the hearing aid. Hereby, it is provided that the hearing aid in the programming mode prevents the change to the standby mode. This has the advantage that the connection does not have to be repeatedly reactivated which would result in delays and hence in lower data rates. In addition, it is also ensured that the hearing aid receives all of the programming data correctly. However, hereby it is also advantageous for the hearing aid in the programming mode automatically to change to the receiving mode or the standby mode programming mode after the expiry of a prespecified time. The choice of a suitably long time can ensure that the risk of an interruption to the programming is minimized. Simultaneously, it is possible to ensure that the hearing aid is not incorrectly programmed by data which it inadvertently receives outside of the programming mode.

In addition, in a further embodiment of the invention, the hearing aid can prevent the automatic change from the programming mode to the receiving mode or the standby mode if a new programming access via the wireless connection takes place within the prespecified time. This is advantageous, since it enables unnecessary interruptions of the programming to be prevented.

Finally, in a further advantageous embodiment of the invention, it is provided that the hearing aid in the programming mode resets the time for the automatic change of operating mode if a new programming access takes place or when the hearing aid receives an audio data flow. This measure also means the unnecessary interruption of the programming of the hearing aid can be prevented.

BRIEF DESCRIPTION OF THE DRAWINGS

The following describes the invention in more detail with reference to drawings which show.

DETAILED DESCRIPTION OF INVENTION

Figure 1:
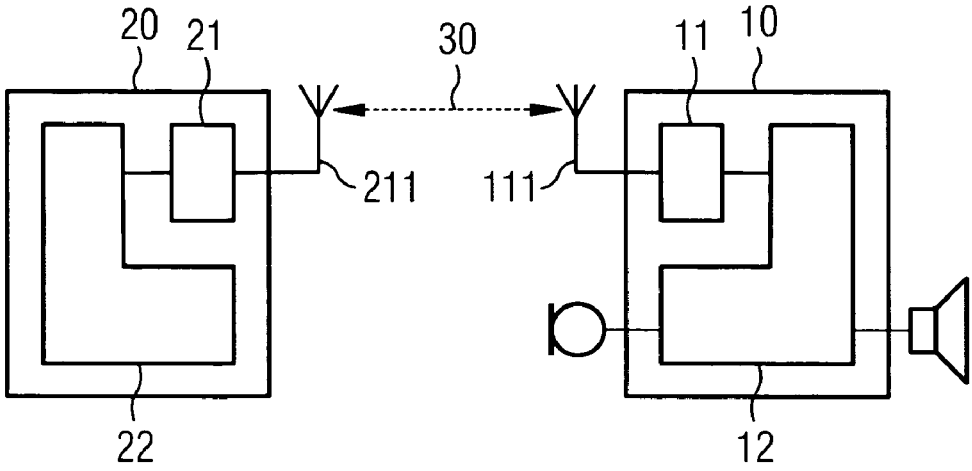
FIG. 1 a schematic view of a hearing aid and an external device connected to each other via a wireless transmission path.

FIG. 1 shows a typical hearing aid 10, which, in addition to further circuits 12, also has an interface 11,111 for wireless data transfer. This interface 11,111 has a receiving device 11 and an antenna 111 connected to the receiving device 11. The receiving device 11 is preferably embodied as a transmission/receiving device or as a part of such a device, as long as the hearing aid 10 is embodied for both the wireless reception and the wireless transmission of data. However, for reasons of clarity, the optionally separate transmission circuit is not depicted in any more detail here. As long as bidirectional communication is supported, the antenna 111 then also preferably works in the transmitting and receiving direction. The hearing aid 10 shown in FIG. 1 is connected via a wireless transmission path 30 to an external device 20 in order to receive data from this device 20. For this, the external device 20 also has a corresponding antenna 211 and a corresponding transmitting and receiving device 21. Here, a possible external device 20 is, for example, a further hearing aid which is binaurally coupled to the first hearing aid 10 via the wireless connection. In addition, the external device 20 can also be embodied as a control or programming device serving to control or program the hearing aid 10 or as a so-called remote control, which, for example, within the scope of wireless programming, establishes a wireless connection with the hearing aid 10.

In addition to the receiving device 11, the hearing aid 10 also has further circuits 12, such as, for example, control circuits and signal processing circuits. Since these circuits are of no relevance for understanding the invention, they are shown as schematically summarized in FIG. 1. In addition to a transmitting/receiving device 21 and an antenna 211, the external device 20 also typically has further circuit parts 22 which are also shown as schematically summarized in FIG. 1.

As a rule, during operation, the only power supply for the hearing aid 10 is its internal battery. Due to its small dimensions, the housing of the hearing aid 10 can only accommodate a relatively small battery. Due to the relatively small battery, the service life of the hearing aid is already greatly restricted in normal operation. In addition, the wireless data reception places a great load on the power supply of the hearing aid 10. The concept according to the invention should achieve a significant power saving in the hearing aid 10.

Figure 2:
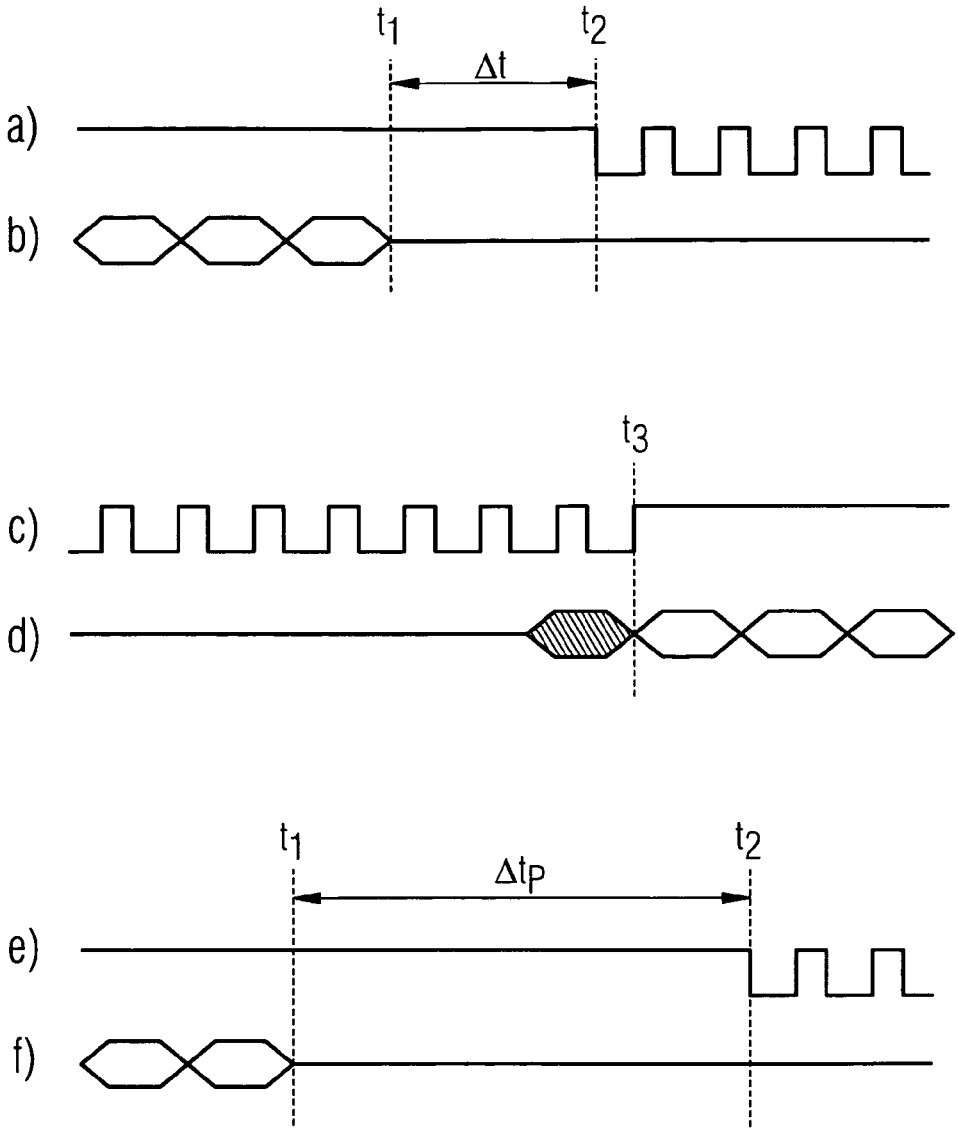
FIG. 2 a schematic view of a temporal signal course when changing between the different operating modes.

The following explains the procedure on the change of the different operating modes with reference to FIG. 2. Here, the first diagram a) shows the temporal course of the switched-on and switched-off times of the receiving device 11 of the hearing aid 10 when switching from the receiving mode to the standby mode. The switched-on and switched-off times are represented by means of a binary signal, wherein the value "high" stands for a switched-on time and the value "low" for a switched-off time. The receiving device 11 is constantly switched on in the receiving mode in order to receive the data sent by the external device 20 via the wireless connection without delay. The temporal course of the data from the external device 20 received by the hearing aid 10 is depicted in the accompanying diagram b), wherein the hearing aid 10 only receives data via the wireless connection at the start. According to the invention, the hearing aid 10 should switch to the standby mode when it is no longer receiving data from the external device 20. As shown in diagram a) of FIG. 2, this change of operating mode takes place at time t2. The hearing aid 10 had been receiving data from the external device 20 up to the preceding time $t_1$. After the expiry of a prespecified time interval Δt in which it was no longer receiving data, it now switches automatically to the standby mode. In this operating mode, the receiving device 11 is preferably periodically switched on and off. Therefore, in this operating mode, described as the sniff mode, the hearing aid 10 "sniffles" virtually repeatedly into the transfer channel in order to detect the start of a new data transfer. The pulse duty ratio selected in the standby mode in the present example, that is the duration of a switched-on phase in relation to the duration of a switched-off phase, is ⅔. Depending on the requirement, this pulse duty ratio can be shifted to extreme values in the standby mode by shortening the switched-on times and/or lengthening the switched-off times. In principle, this can achieve up to 90% power saving. However, the switched-on and switched-off times should be selected so that the start of a data transfer from the external device 20 is detected in every case, since this can result in unwanted delays. It is therefore advisable to match the switched-on and the switched-off times and the duration of the activation signal to each other.

In addition, the time interval Δt, after which the hearing aid 10 switches to the standby mode as long as it is no longer receiving any further data, should be selected so that short transmission pauses, which can typically occur during the communication between the hearing aid 10 and the external device 20, do not result in a change of the operating modes. This is because over-frequent changes of operating mode and the associated reactivation procedures of the receiving device could result in delays in the data transfer and consequently in an unwanted reduction of the data rate.

According to the invention, the hearing aid 10 should switch back to the receiving mode as soon as it has registered the start of a data transfer in the standby mode. A change of operating mode of this kind is shown in the pair of diagrams c) and d) in FIG. 2. In the standby mode, the hearing aid 10 samples the transfer channel by periodically switching its receiving device 11 on and off. Before the external device 20 sends data to the hearing aid 10, it preferably notifies the hearing aid 10 of this. This is preferably performed by means of a specific activation signal which is sent in advance of a data transfer via the wireless transmission path 30 to the hearing aid 10. This activation signal is indicated in diagram d) by a hatched data field. To ensure that the activation signal is not completely transferred during a switched-off phase, which would complicate its detection by the hearing aid 10, the switched-on and switched-off phases of the receiving device 11 and the activation signal have to be matched to each other, wherein it is in particular necessary for the duration of the activation signal to exceed the duration of a switched-off phase. In addition, the switched-on phase must be selected sufficiently long for the part of the activation signal necessary for unambiguous detection to be received during the switched-on phase.

As shown in the two diagrams c) and d), in the present example, the activation signal is more than twice as long as the switched-off time of the receiving device 11 in the standby mode. In a switched-on phase, the hearing aid 10 can therefore unambiguously detect the start of a data transfer by the external device 20. At time t3, the hearing aid 10 therefore changes to the receiving mode in order to receive the actual data then sent from the external device 20.

Whether, after the reception of an activation signal following the prespecified switched-on and switched-off sequence in the standby mode, the hearing aid 10 switches its receiving device 11 off again before it changes to the receiving mode, depends in the first instance on the processing speed in the hearing aid 10. In principle, it is advantageous for the hearing aid 10 to suppress the switched-off cycle in the standby mode as long as it is receiving the activation message but no change of operating mode has taken place. Diagram c) in FIG. 2 only shows the first of the two alternatives.

In order to indicate the start of a new data transfer to its communication partner, the external device 20 can in principle start the data transfer without waiting for the reactivation of the hearing aid 10. As soon as the hearing aid 10 has changed to the receiving mode, the external device 20 sends the data already sent to the hearing aid 10 again in order to ensure that now all the data has been correctly received by the hearing aid 10. Multiple transmissions of this kind are used inter alia also to avoid errors with disrupted data transmission, in particular if there is no reverse channel. However, this approach involves a risk that the hearing aid 10 is unable to detect unambiguously whether the data currently being received is actually the data which it is to utilize or whether these data are still serving to activate the receiving mode and will then be sent once again during the actual data transfer. A faulty interpretation of the data by the hearing aid 10 could in principle result in reception errors. It is therefore advantageous for the external device 20 to use a special activation signal to activate the receiving mode of the hearing aid 10. This activation signal can contain a special activation message and in addition redundant parts such as, for example, a preamble preceding the activation message. It is advantageous to use a preamble preceding the activation message since the hearing aid 10 can already recognize on the reception of a preamble of this kind that a data transfer will take place shortly. In this way, it can suppress the switched-off phases in the standby mode until it has received the activation message and hence optionally also the information into which operating mode it should change. This enables the change of operating mode to be accelerated under some circumstances. To achieve a reliable recognition of the start of the data transfer, the length of the activation signal should exceed the duration of the switched-off phases in the standby mode. This can be achieved by the fact that the activation message in the activation signal is repeated several times until this condition is satisfied. In addition, it is also possible to extend the length of the activation signal by means of the redundant parts until they exceed the duration of a switched-off phase.

Alternatively, the hearing aid 10 can detect the start of a new data transfer from the modulation method used by the external device 20 to transfer its data. Hereby, suitable for this are in particular specific phase or frequency modulation methods, for example, frequency shift keying (FSK) or phase shift keying (PSK). The external device 20 can only use the special modulation method at the start of a new data transfer in order then to transfer the actual data by means of another modulation method. Alternatively, the external device 20 can use a different modulation method for each new data transfer.

In order to ensure reliable programming of the hearing aid 10, it is advantageous to provide a programming mode in the hearing aid 10, wherein received programming commands only result in programming of the hearing aid 10 in this operating mode, while, in another operating mode, they are ignored by the hearing aid 10. Although, in an analogous way to its receiving mode, the hearing aid 10 is hereby permanently switched to receive, the programming mode is preferably an independent operating mode and not a special receiving mode. To ensure reliable programming, the programming mode should have several important features which are not required in the regular receiving mode. Contrary to the case with the regular receiving mode, the change to the programming mode should not take place automatically in order to avoid unintentional programming. Preferably, the hearing aid 10 is only changed to the programming mode via special commands of the external device 20. Typically, the programming of the hearing aid 10 requires higher data rates than, for example, those required during the coupling of the hearing aid 10 to the external device 20, which can be embodied as another hearing aid or as a remote control. Therefore, it is advisable to increase the data rate in the programming mode. To achieve this, power-saving operating modes such as, for example, the standby mode (sniff mode) are deactivated during the programming. This occurs in order not to slow down the communication between the devices 10, 20 during the programming due to unnecessary waiting times which occur due to a repeated reactivation procedure. In addition, the ready-to-receive state of the hearing aid 10 must be permanently guaranteed during the entire programming, which is not the case with a constant change into other operating modes. Preferably, the programming mode is initiated by a command which is transmitted in the lower data rate of the normal operation. Following this, the standby mode is deactivated and the programming mode started in which the higher data rate is now used. Although the automatic change to the standby mode typical for the regular receiving mode is undesirable in the programming mode for the reasons described above, it can be advantageous for the hearing aid 10 only to remain in the programming mode for a preset programming time $\Delta tp$ and after the expiry of this time automatically to return to the normal operating mode. The change to a reliable operating mode can enable it to be ensured that no unintentional change to the programming occurs. In addition, a change to the standby mode reduces the load on the internal power supply of the hearing aid 10. The time interval $\Delta tp$ after which the hearing aid 10 switches from programming mode to a normal operating mode, is typically much longer than the time interval $\Delta t$ after which the hearing aid 10 changes from the receiving mode to the standby mode. This is evident in FIG. 2 from a comparison of the two diagrams a) and b) with the two diagrams e) and f), wherein the illustration is not true to scale.

In addition, in the programming mode, the prespecified programming time $\Delta tp$ can be reset and restarted by a programming access. It is also possible for a received audio data flow to reset this time $\Delta tp$ as long as the system supports the transfer of audio data flows during the programming.

The invention claimed is:

1. A method for a wireless data transfer between a hearing aid and an external device, comprising: receiving data sent from the external device by an internal receiving device in the hearing aid, the data received via a wireless connection; switching the hearing aid into a receiving mode in response to the receiving data; wherein while the internal receiving device is in the receiving mode the internal receiving device is constantly switched on in order to receive the data; and switching the hearing aid to a standby mode in response to no data being received from the external device via the wireless connection, wherein while the internal receiving device is in the standby mode the internal receiving device is alternately switched on and off in a uniformly repeating duty ratio of on/off durations in order to detect the receipt of further data from the external device via the wireless connection; wherein the duration of the switched-on and switched-off phases of the internal I receiving device in standby mode is selected within a duty ratio range of 1/9 to 2/3 in order to detect the receipt of the further data from the external device via the wireless connection.

2. The method as claimed in claim 1, wherein the hearing aid in the switched-on phase of the standby mode changes to the receiving mode when the internal receiving device detects the receipt of the further data from the external device via the wireless connection.

3. The method as claimed in claim 1, wherein the hearing aid changes from the receiving mode to the standby mode when the internal receiving device within a prespecified time detects no data being received from the external device via the wireless connection.

4. The method as claimed in claim 1, wherein the hearing aid receives an activation signal from the external device via the wireless connection in order to indicate to the hearing aid the start of a further data.

5. The method as claimed in claim 4, wherein the duration of the activation signal exceeds the duration of the switched-off phase of the internal receiving device in the standby mode of the hearing aid.

6. The method as claimed in claim 4, wherein the activation signal comprises an activation message and a redundant preamble, and wherein the duration of the redundant preamble is selected so that the total duration of the activation signal exceeds the duration of the switched-off phase of the internal receiving device in the standby mode of the hearing aid.

7. The method as claimed claim 6, wherein the activation message in the activation signal is repeated until the total duration of the activation signal exceeds the duration of the switched-off phase of the internal receiving device in the standby mode of the hearing aid.

8. The method as claimed in claim 1, wherein the external device uses a specific carrier modulation method in order to indicate the start of the further data and wherein the hearing aid changes to the receiving mode when the internal receiving device receives a data with the specific carrier modulation method.

9. The method as claimed in claim 8, wherein the specific carrier modulation method is selected from either phase modulation or frequency modulation, and the specific modulation method is only used for data transfer, and the hearing aid changes to the receiving mode when the internal receiving device receives a data with the specific carrier modulation method.

10. The method as claimed in claim 1, wherein a data receipt occurs within the scope of wireless programming of the hearing aid, and wherein the hearing aid in a programming mode receives programming data from the external device serving as a control device in order to wirelessly program the hearing aid.

11. The method as claimed in claim 10, further comprising:

changing the hearing aid to the programming mode as soon as a special command is received from the control device via the wireless connection, wherein programming data received by the hearing aid outside of the programming mode via the wireless connection is ignored by the hearing aid.

12. The method as claimed in claim 10 further comprising:

preventing a change of the hearing aid to the standby mode when the hearing aid is in the programming mode.

13. The method as claimed in claim 10, further comprising:

automatically changing the hearing aid from the programming mode to the receiving mode or the standby mode after an expiry of a prespecified time.

14. The method as claimed in claim 13, wherein the automatic changing the hearing aid from the programming mode to the receiving mode or the standby mode is prevented when another programming access via the wireless connection is made within the prespecified time.

15. The method as claimed in claim 14, wherein the hearing aid in the programming mode resets the time for the automatic change when another programming access takes place or when the hearing aid receives an audio data flow.

16. A hearing aid, comprising: an internal receiving device that receives data from an external device via a wireless connection; a plurality of operating modes in which a behavior of the internal receiving device is modified based on a current operating mode; wherein when the current operating mode is a receiving mode the internal receiving device is constantly switched on; wherein when the current operating mode is a standby mode the internal receiving device is alternately switched on and off in a uniformly repeating duty ratio of on/off durations; wherein the current operating mode is switched from the receiving mode to the standby mode when no data is received from the internal receiving device for a predetermined duration of time; and wherein the current operating mode is switched from the standby mode to the receiving mode when data is received during the switched on phase of the internal receiving device; wherein the duration of the switched-on and switched-off phases of the internal receiving device in standby mode is selected within a duty ratio range of 1/9 to 2/3 in order to detect the receipt of the data from the external device via the wireless connection; wherein the hearing aid receives an activation signal from the external device via the wireless connection in order to indicate to the hearing aid the start of a transfer of data; and wherein the duration of the activation signal exceeds the duration of the switched-off phase of the internal receiving device in the standby mode of the hearing aid.

17. The hearing aid as claimed in claim 16, wherein when the current operating mode is a programming mode the external device serves as a control device to wirelessly program the hearing aid, wherein the current operating mode is changed to the programming mode after a receipt of a special command from the control device via the wireless connection, and wherein programming data received by the hearing aid when the current operating mode is not the programming mode is ignored by the hearing aid.

18. The hearing aid as claimed in claim 17, wherein when the current operating mode is in the programming mode a change to the standby mode is prevented.

* * * * *